US005993198A

United States Patent [19]

Adams et al.

[11] Patent Number: 5,993,198

[45] Date of Patent: Nov. 30, 1999

[54] REDUCED RESISTENCE DEVICE FOR PRODUCING IGNITION SPARKS

[75] Inventors: Paul H. Adams, Monroe; James M. McDonough, Guilford, both of Conn.; Jean Michel Monnier, Cleveland, Miss.

[73] Assignee: BIC Corporation, Milford, Conn.

[21] Appl. No.: 08/798,579

[22] Filed: Feb. 10, 1997

[51] Int. Cl.[6] ..... F23Q 1/02

[52] U.S. Cl. ..... 431/273; 431/153

[58] Field of Search ..... 431/277, 153, 431/273, 274, 276, 255, 144, 145

[56] References Cited

U.S. PATENT DOCUMENTS

| | | | |
|---|---|---|---|
| 3,910,751 | 10/1975 | Chernock | 431/273 |
| 3,910,752 | 10/1975 | Holl | 431/273 |
| 4,509,916 | 4/1985 | Laforest Le Boudec | 431/273 |
| 5,520,197 | 5/1996 | McDonough et al. | 431/273 |

FOREIGN PATENT DOCUMENTS

| | | |
|---|---|---|
| 51-112678 | 10/1976 | Japan . |
| 54-31370 | 3/1979 | Japan . |

*Primary Examiner*—James C. Yeung
*Attorney, Agent, or Firm*—Pennie & Edmonds LLP

[57] ABSTRACT

An apparatus is disclosed for providing more uniform lighter spark wheel actuation. Uniform actuation is facilitated in the apparatus according to the invention by reducing the formation of deep grooves and high ridges in the flint. In one embodiment of the invention, a spark wheel coil formed from wire having at least one substantially flat side is utilized to reduce ridge formation. The spark wheel coil includes pitting in a transversal direction made on the outer surface of the coil. The pitting forms projections which protrude from the core of the coil and which, when contacting a pyrophoric flint while the coil spring is rotated about its axis, produce a tangential cutting across the pyrophoric flint to emit an ignition spark.

9 Claims, 4 Drawing Sheets

REDUCED RESISTENCE DEVICE FOR PRODUCING IGNITION SPARKS

BACKGROUND OF THE INVENTION

1. Technical Field

The present invention relates to a lighter which consumes hydrocarbon fuel such as butane and includes a spark producing means Specifically, the present invention relates to an improved spark producing means for a lighter which is more uniformly operatable.

2. Discussion of the Related Art

A conventional cigarette lighter includes a body containing a fuel reservoir filled with a liquified and pressurized hydrocarbon fuel, a valve actuator lever, a spark wheel, a flint in frictional contact with the spark wheel, and a fuel flow control valve in fluid communication with the fuel reservoir. After the spark wheel is rotated against the flint by digital manipulation to produce sparks, the valve actuator lever is depressed allowing gaseous hydrocarbon fuel to flow out of the reservoir through the flow control valve. The sparks then ignite the released fuel to produce a flame. Such lighters are known in the art and are commercially available.

Specific means for producing ignition sparks when contacting a pyrophoric flint in these lighters are also known in the art. For example, U.S. Pat. No. 4,509,916 to Le Boudec discloses a device for producing an ignition spark when contacting a flint. The device includes a flint cutting member made from helically-coiled wire with a circular cross section which includes saw-teeth projections for contacting and cutting the flint to create sparks. The flint, like the coiled wire, also includes a circular cross section. The device may be configured and adapted for use as a spark wheel in known lighters.

However, these related art spark producing means are disadvantageous in that irregular friction is produced between the flint and the user-rotatable spark wheel. This irregular friction leads to non-uniform rotational force requirements for rotating the spark wheel, and thus may increase the difficulty in producing ignition sparks.

More particularly, when a flint with a circular cross section is utilized in conjunction with a art spark wheel coil fashioned from wire with a circular cross section, the surface of the flint contacting the coil becomes deeply grooved over time so as to match the curved coil surface. The same difficulty can also arise with spark wheel assemblies having a flint cutting member made from a solid cylinder rather than coiled wire. Such solid cylinders are typically cut with a spiral groove on the outer surface to improve the spark creating characteristics of the part. This spiral groove in the cutting member can also result in a deeply grooved flint, such as encountered with the coiled wire cutting members. In addition, the rotation of such cutting members against the flint during use urges the flint to rotate about its central axis.

These two factors, i.e., the deep grooving of the flint surface (and resulting high ridges) and the urged rotation of the flint during use, are disadvantageous in combination as they bring about non-uniform user actuation of the spark wheel. More specifically, the flint, with a highly ridged/deeply grooved striking surface as shown in FIG. 7A, provides a significant non-uniform resistance to rotation of the spark wheel assembly as the cutting member is required to periodically breakdown the high ridges as it is rotated. The nonuniformity of the force required to rotate the spark wheel assembly can be increased further when the flint itself rotates on its axis as a result of the screw thread like action of the cutting member on the flint. Such rotation of the flint is difficult for the user to overcome due to the high ridges on the flint surface which require a relatively high force to break through.

Highly non-uniform resistance is especially disadvantageous in many of the newer child resistant lighters. For example, U.S. Pat. No. 5,483,978 to Doiron discloses a child resistant lighter with a guard which partially covers the spark wheel, thereby increasing the difficulty of rotating the same. This spark wheel cover, when combined with the non-uniform force requirements of the prior art spark producing means can result in non-uniform and unpredictable increases in the difficulty of lighter actuation by intended users.

OBJECTIVES AND SUMMARY OF THE INVENTION

In view of the above disadvantages of the related art, it is an object of the present invention to provide a spark producing means which facilitates smooth, uniform actuation by intended users.

It is a further object of the invention to provide such a spark producing means that is relatively easy to manufacture and that requires minimal design modification.

In accordance with the present invention, a flame producing lighter is provided which includes a lighter body containing a fuel reservoir with a valve for releasing fuel. The lighter further includes a valve actuator depressible by a user to actuate said valve and release said fuel, and a spark producing element rotatable by a user to produce sparks directed towards the released fuel. In addition, the lighter includes a flint contained within the lighter body and in frictional contact with the spark producing element wherein rotation of the spark producing element against the flint creates sparks directed towards released fuel.

In the lighter according to the present invention, uniform spark wheel actuation is facilitated by decreasing the peak force required for rotation of the spark wheel. In an exemplary embodiment of the invention, a spark wheel coil having one or more loops and formed from wire having an outer flat face is utilized to prevent the formation of deep grooves (and concomitant high ridges) in the flint striking surface which increase the peak force required to rotate the spark wheel for generation of sparks. The spark wheel coil includes pitting in a transversal direction made on the outer surface of said one or more loops. The pitting forms projections which protrude from the core of the coil and which, when contacting a pyrophoric flint while said coil spring is rotated about its axis, produce a tangential dragging or cutting across the pyrophoric flint to emit an ignition spark. Use of wire with at least a substantially flat outer face ensures that during actuation, deep grooves and high ridges are not formed in the flint striking surface.

BRIEF DESCRIPTION OF THE DRAWINGS

These and other methods, structures, features, aspects, and advantages of the present invention will become more readily apparent from the following detailed description, which should be read in conjunction with the accompanying drawings, in which:

FIGS. 5A–5B illustrate a flame producing lighter containing a spark wheel according to the invention, wherein FIG. 5A is a side view of a flame producing lighter, and FIG. 5B is a cross-sectional view of the top portion of a flame producing lighter;

FIGS. 7A–7B are outlines of the profile of a flint as acted on by a spark wheel, wherein FIG. 7A illustrates the grooves and high ridges resulting from the prior art spark wheel, and FIG. 7B illustrates the comparatively flat surface resulting from the spark wheel of the present invention.

DETAILED DESCRIPTION OF THE INVENTION

Figure 1:
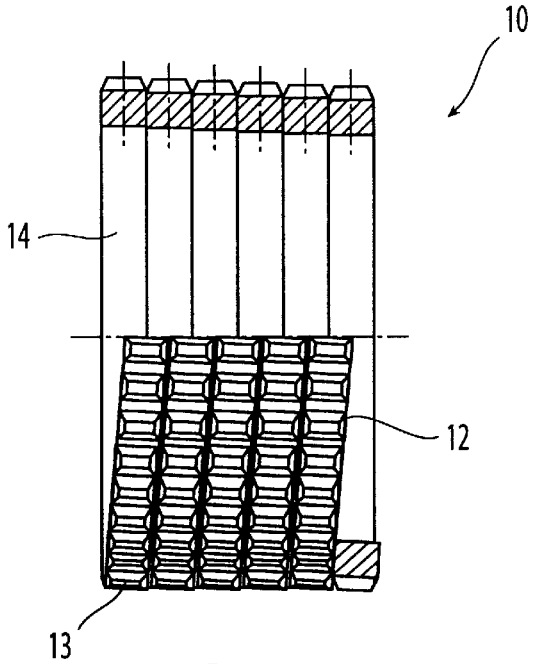
FIG. 1 is a partial cross-sectional front view of a spark wheel coil cutting member according to the invention.

The following embodiments of the present invention will be described in the context of a lighter including a spark producing means, although those skilled in the art will recognize that the disclosed methods and structures are readily adaptable for broader application. Note that whenever the same reference numeral is repeated with respect to different figures, it refers to the corresponding structure in each such figure.

Figure 7A:
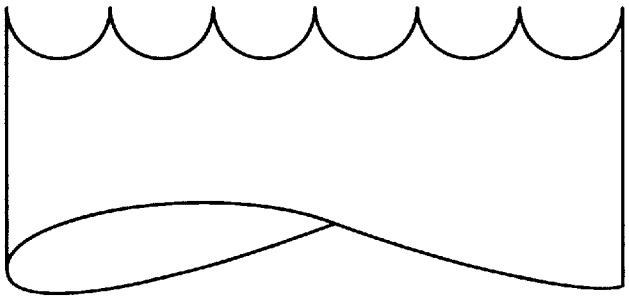
Fig. 7A Prior Art

As previously mentioned, when a flint is utilized in conjunction with a spark wheel cutting member fashioned from wire with a circular cross section or a similarly formed cylindrical cutting member, the surface of the flint contacting the cutting member becomes deeply grooved over time so as to match the cutting member surface as illustrated in FIG. 7A. Moreover, the rotation of the spirally formed cutting member contacting the flint during use acts like a screw thread on the deep angled grooves, urging the flint to rotate about its central axis. Eventually, the spiral cutting surface results in particular spots in the rotation of the spark wheel having increased resistance to rotation. This localized increase in resistance is irregular and creates a peak force for rotation that is difficult or impossible for some intended users to overcome.

Figure 7B:
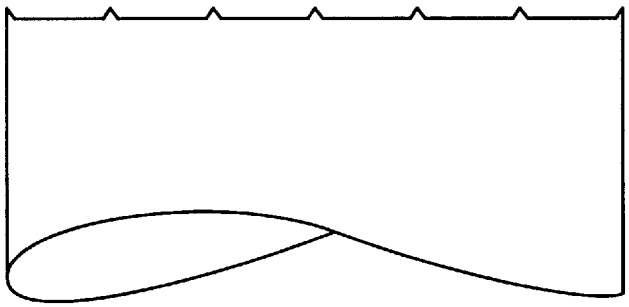

Thus, in accordance with the invention, uniform spark wheel actuation is facilitated by reducing the peak force necessary for rotation of the spark wheel assembly. In an exemplary embodiment of the invention, a spark wheel coil having one or more loops and formed from wire having a substantially flat outer surface is utilized. Use of wire with a substantially flat outer surface reduces or eliminates the deep grooves and high ridges formed in the flint, as illustrated in FIG. 7B. Thus, during actuation, such high ridges are not engaged by and do not need to be broken through by the spark wheel cutting member and the peak force necessary for rotation is thereby reduced.

Figure 2:
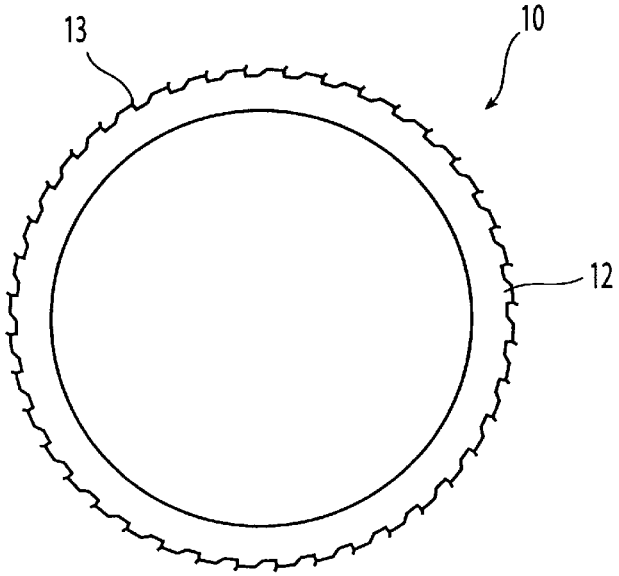
FIG. 2 is a side view of a spark wheel coil according to the invention.

In accordance with the foregoing, FIG. 1 discloses a helical spark wheel coil 10 for contacting a pyrophoric flint so as to create sparks. In accordance with a preferred embodiment of the invention, spark wheel coil 10 is comprised of a wire formed into numerous loops 14. The wire is substantially square when viewed cross-sectionally, and includes a plurality of projections 12 on the outer surface. As shown in FIG. 2, each projection 12 is preferably formed to include a tooth 13 for increasing cutting action between the coil 10 and a pyrophoric flint during use. The formation and hardening of projections 12 or teeth 13 is accomplished by standard forming and heat treating techniques as known is the art and described in U.S. Pat. No. 4,509,916, which is incorporated by reference herein.

Figure 3A:
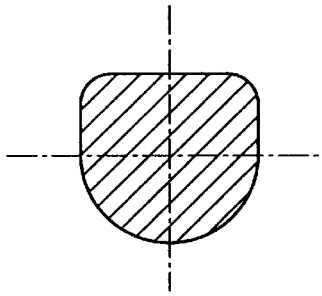
FIGS. 3A–3B are cross-sectional views of alternative wire shapes for use in the present invention.
Figure 3B:
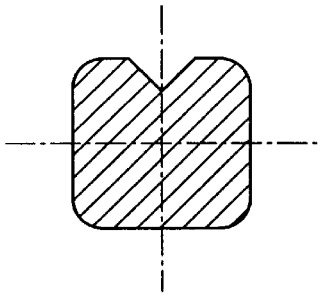

FIGS. 3A and 3B, illustrate, respectively, a half round or substantially half-round wire and a substantially square, grooved wire which also may be used to form a coiled cutting member according to the invention. The common element between the various wire shapes is the flat outer surface which permits the elimination or minimization of high ridges in the flint as previously explained. A narrow groove in the flat outer surface, as shown in FIG. 3B, may further enhance spark generation by reducing the size of the cuttings.

Figure 4:
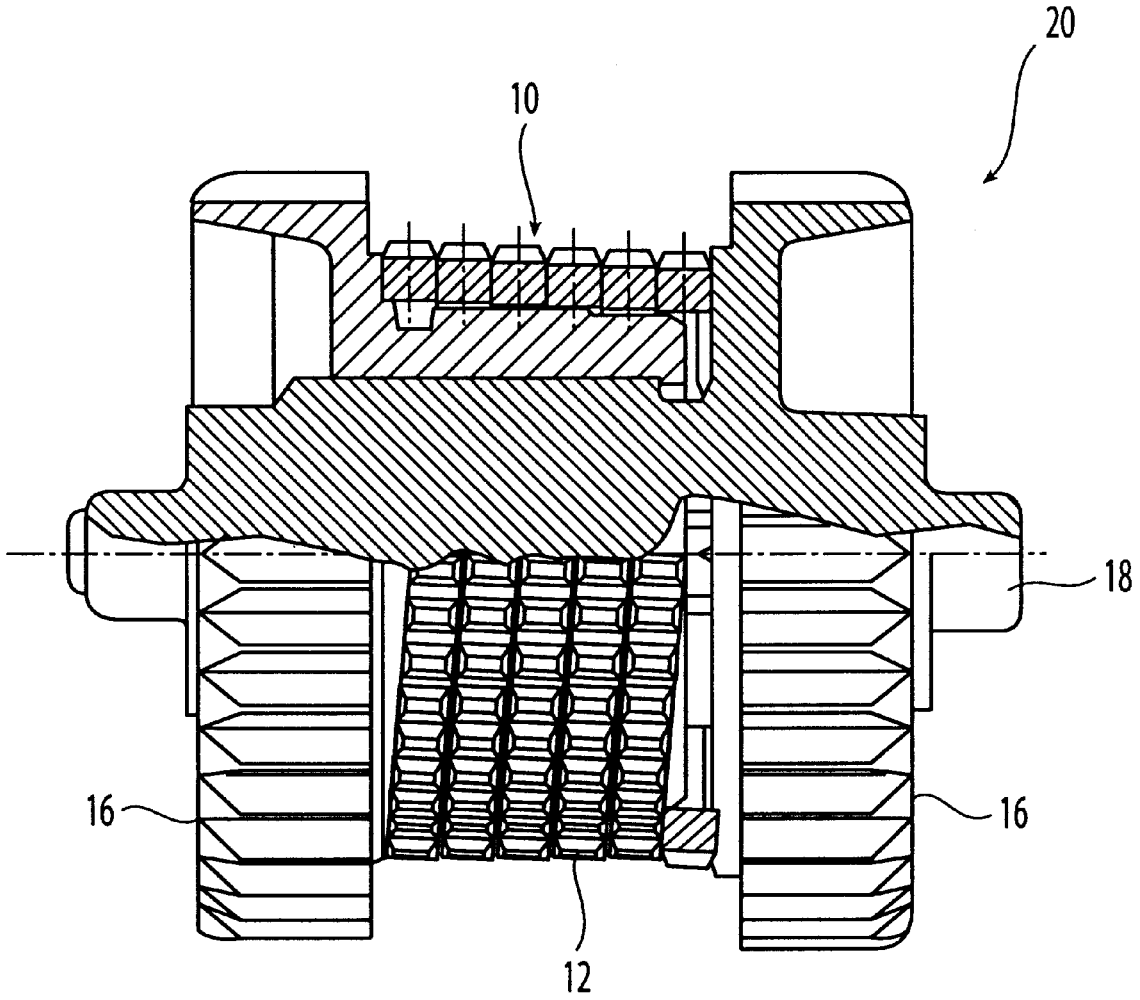
FIG. 4 is a partial cross-sectional front view of a spark wheel assembly according to the invention.

FIG. 4 shows a spark wheel assembly 20 employing helical spark wheel coil 10 in accordance with the invention. As shown in FIG. 4, coil 10 may be disposed between turning wheels 16. Coil 10 and turning wheels 16 are connected to one another and mounted coaxially on axle 18 so as to form the spark wheel assembly.

Figure 5A:
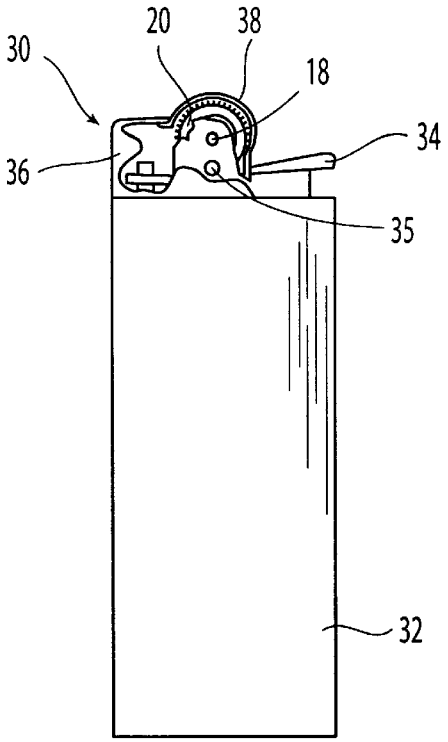
Figure 5B:
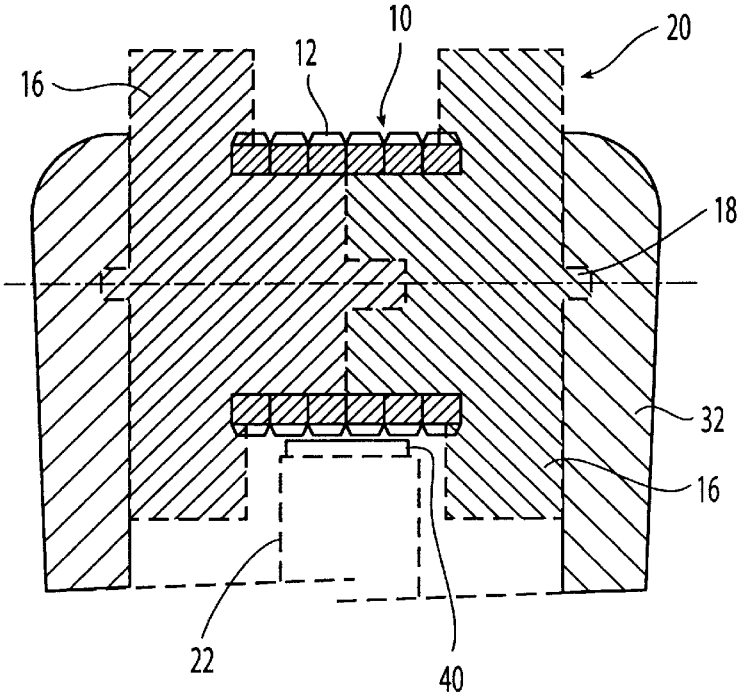

In accordance with the invention, spark wheel assembly 20 may be used in conjunction with other mechanisms so as to form a lighter. More particularly, and as shown in FIGS. 5A and 5B, spark wheel assembly 20 may be mounted on the body 32 of a lighter 30 defining a central cavity. A pyrophoric flint 40 may be securely disposed in a cylindrical chamber 22 positioned within body 32 to cooperate with the spark wheel assembly, and may be urged into frictional contact with coil 10 by a spring (not shown). Lighter 30 further comprises a valve actuator 34 which is pivotally mounted on body 32 through tabs 35, located below axle 18. Valve actuator 34 controls the release of fluid from a fuel reservoir within lighter body 32.

Lighter 30 further includes a windshield 36, and a protective guard 38, which as previously discussed, is disposed above a portion of spark wheel assembly 20 so as to deter operation by unintended users. Such a lighter is described, for example, in detail in U.S. Pat. No. 5,520,197 to McDonough et al., which is incorporated herein by reference, and its construction and operation are well understood by persons of skill in the art. Similarly, the present invention is equally advantageous when utilized in conjunction with other child-resistancy means wherein the focus is on increased difficulty of spark creation by unintended users. Examples of lighters employing such means are U.S. Pat. No. 5,490,773 to Lloveras Capilla and U.S. Pat. No. 5,096,414 to Zellweger, both of which are incorporated by reference herein. By utilizing the present invention with these devices, the enhanced uniformity of operation will facilitate operation by intended users, without negatively impacting the child-resistancy.

Figure 6:
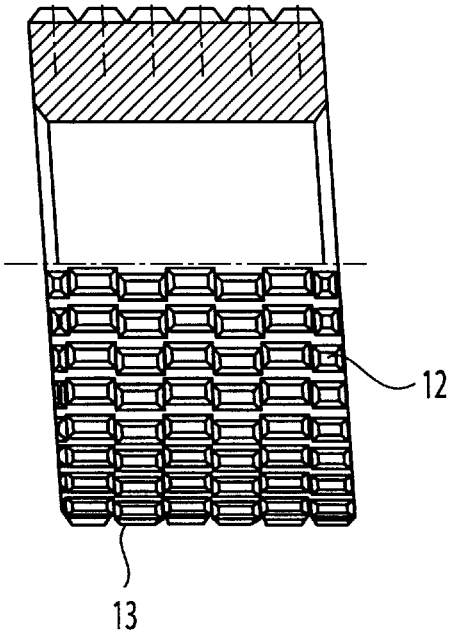
FIG. 6 is a partial cross-sectional front view of an alternative cutting member according to the invention.

FIG. 6 illustrates an alternative cutting member according to the present invention. Rather than being formed from a coiled wire, the cutting member shown in FIG. 6 is formed from a cylindrical member, which may be solid or hollow depending on the particular spark wheel assembly. Teeth are cut into the outer surface of the cylindrical member in a helical pattern which substantially matches that achieved with a coiled wire having a flat outer surface.

Various embodiments of the invention have been described. The descriptions are intended to be illustrative, not limitative. Thus, it will be apparent to those skilled in the art that modifications may be made to the invention as described without departing from the scope of the claims set out below.

We claim:

1. A flame producing lighter, comprising:

a lighter body containing a fuel reservoir with a valve for releasing fuel therefrom;

a valve actuator depressible by a user to actuate said valve and release said fuel;

a spark producing element rotatable by a user to produce sparks directed towards released fuel, said spark producing element mounted on said lighter body with at least a portion thereof exposed for manipulation and rotation by the user, said spark producing element comprising a coil having a substantially flat outer surface, said coil includes a plurality of projections on the outer surface;

a flint contained within the lighter body and in frictional contact with the projections on the spark producing element wherein rotation of the spark producing element against the flint creates sparks directed towards released fuel.

2. The lighter according to claim 1, wherein the coil comprises at least one loop formed from a wire, which has a substantially square cross section.

3. The lighter according to claim 1, wherein the coil comprises at least one loop formed from a wire, which has a substantially half round cross section.

4. The flame producing lighter according to claim 1 further comprises a means for increasing the difficulty of spark generation by unintended users.

5. The flame producing lighter according to claim 1, wherein the projections include at least one tooth to increase the cutting action between the spring and the flint.

6. The flame producing lighter according to claim 1, wherein the substantially flat surface of the coils defines a groove thereon.

7. An apparatus for producing ignition sparks when contacting a pyrophoric flint, comprising:

a coil spring with an outer surface having one or more coils having at least one substantially flat face, wherein the one or more coils are wound with said substantially flat face on the coil outer surface;

said one or more coils provided with a pitting in a transverse direction made on the outer surface of said one or more coils;

said pitting being formed of projections which protrude from the core of the one or more coils and which, when contacting a pyrophoric flint while said coil spring is rotated about its axis, produce a tangential cutting across the pyrophoric flint thereby emitting an ignition spark.

8. The apparatus according to claim 7, wherein the one or more coils have a substantially square cross section.

9. The apparatus according to claim 7, wherein the one or more coils have a substantially half round cross section.

* * * * *